US006102748A

United States Patent [19]

Lee et al.

[11] Patent Number: 6,102,748

[45] Date of Patent: Aug. 15, 2000

[54] HIGH DENSITY ELECTRICAL CONNECTOR AND METHOD OF MANUFACTURING THE SAME

[75] Inventors: Ming-Wu Lee; Kun-Tsan Wu, both of Tu-Chen; Jen-Jou Chang, Yung-Ho, all of Taiwan

[73] Assignee: Hon Hai Precision Ind. Co., Ltd., Taipei Hsien, Taiwan

[21] Appl. No.: 09/412,883

[22] Filed: Oct. 5, 1999

[30] Foreign Application Priority Data

Dec. 24, 1998 [TW] Taiwan ..... 87121638

[51] Int. Cl.[7] ..... H01R 13/504

[52] U.S. Cl. ..... 439/736

[58] Field of Search ..... 439/736, 660, 439/701

[56] References Cited

U.S. PATENT DOCUMENTS 4,865,562 9/1989 Burg et al. ..... 439/736

6,007,387 12/1999 Uchiyama ..... 439/736

*Primary Examiner*—Gary F. Paumen

*Attorney, Agent, or Firm*—Wei Te Chung

[57] ABSTRACT

A high-density electrical connector comprises a housing, two sets of SMT contacts insert molded in opposite sides of the housing, and a shield covering the housing. The housing comprises a first housing member and a second housing member surroundingly incorporating the first housing member. A recess is defined between the first and second housing members. A method of manufacturing the high-density connector comprises the steps of: 1) insert molding a pair of SMT contact carriers to opposite sides of the first housing member; 2) insert molding the first housing member having the two SMT contact carriers to the second housing member; 3) severing carrier plates from the two SMT contact carriers; 4) assembling the shield to the housing. The first insert molding forms a base and a crossbeam retaining mounting and mating portions of the SMT contacts with a gap defined therebetween. The base defines a plurality of openings. The second insert molding fills the openings and the gap to incorporate the base and the crossbeam to form the housing.

1 Claim, 8 Drawing Sheets

HIGH DENSITY ELECTRICAL CONNECTOR AND METHOD OF MANUFACTURING THE SAME

BACKGROUND OF THE INVENTION

The present invention relates to a high-density electrical connector and a manufacturing method to make the same.

DESCRIPTION OF THE PRIOR ART

As computer technology advances, high-density portable electronic devices are becoming increasingly popular. Connectors of such electronic devices generally have a large number of conductive contacts densely aligned in a dielectric housing thereof. Such high-density connectors must be designed to fulfill requirements of proper alignment, engagement and coplanarity of the contacts assembled in the housing. Contacts of conventional connectors are usually inserted into manufactured housings. However, achieving reliability of all the contacts assembled in the housing is difficult for high-density connectors because the contacts often change shape during insertion. In addition, insertion of contacts into the housing may damage the housing because the walls of a high-density connector are very thin. Hence, an improved electrical connector is required to overcome the disadvantages of the prior art.

BRIEF SUMMARY OF THE INVENTION

A first object of the present invention is to provide a high-density electrical connector having contacts properly assembled in a housing thereof.

A second object of the present invention is to provide a method of manufacturing a high-density electrical connector whereby the contacts of the connector are retained in the housing by insert molding.

A third object of the present invention is to provide a method of manufacturing connectors at a low cost and high efficiency.

Accordingly, a high-density electrical connector in accordance with the present invention comprises two rows of SMT contacts each having a mating portion and a mounting portion, an insert molded dielectric housing formed to retain the contacts therein and a shield covering a mating face of the housing. A manufacturing method for producing the high-density electrical connector comprises the steps of:

a. Manufacturing and positioning a pair of SMT contact carriers:

An SMT contact carrier comprises a plurality of SMT contacts which are stamped and formed from sheet of metal, and a carrier plate joining the SMT contacts together. Two SMT contact carriers are positioned with mating portions thereof opposite one another and spaced apart a fixed distance, upper extremities of the mating portions being coplanar.

b. First insert molding:

The pair of positioned SMT contact carriers are placed in a first mold and molten dielectric material is injected therein. When cooled, the molten dielectric material solidifies to form a base having a plurality of openings, a crossbeam and a gap between the base and the crossbeam, the SMT contact carriers being embedded in the base and the crossbeam with mounting portions thereof protruding from opposite sides of the base.

c. Second insert molding:

The base and the crossbeam formed in step "b" together with the SMT contact carriers are positioned in a second mold. The same kind of molten dielectric material used in step "b" is injected into the second mold. The molten dielectric material firstly flows through and fills the openings of the base and the gap between the base and the crossbeam to constitute a first housing member, and then forms a second housing member surroundingly incorporating the first housing member to form the housing.

d. Severing the carrier plates from the SMT contact carriers:

The carrier plates are severed from the contact mounting portions of the SMT contact carriers at predetermined positions.

e. Assembling the shield to the housing:

The shield is assembled to a mating face of the housing. A pair of nuts is upwardly inserted through the housing and the shield with heads thereof extending beyond the shield. The heads are riveted to the shield to join the shield and the housing together.

Other objects, advantages and novel features of the invention will become more apparent from the following detailed description of the present embodiment when taken in conjunction with the accompanying drawings.

DETAILED DESCRIPTION OF THE INVENTION

Figure 9:
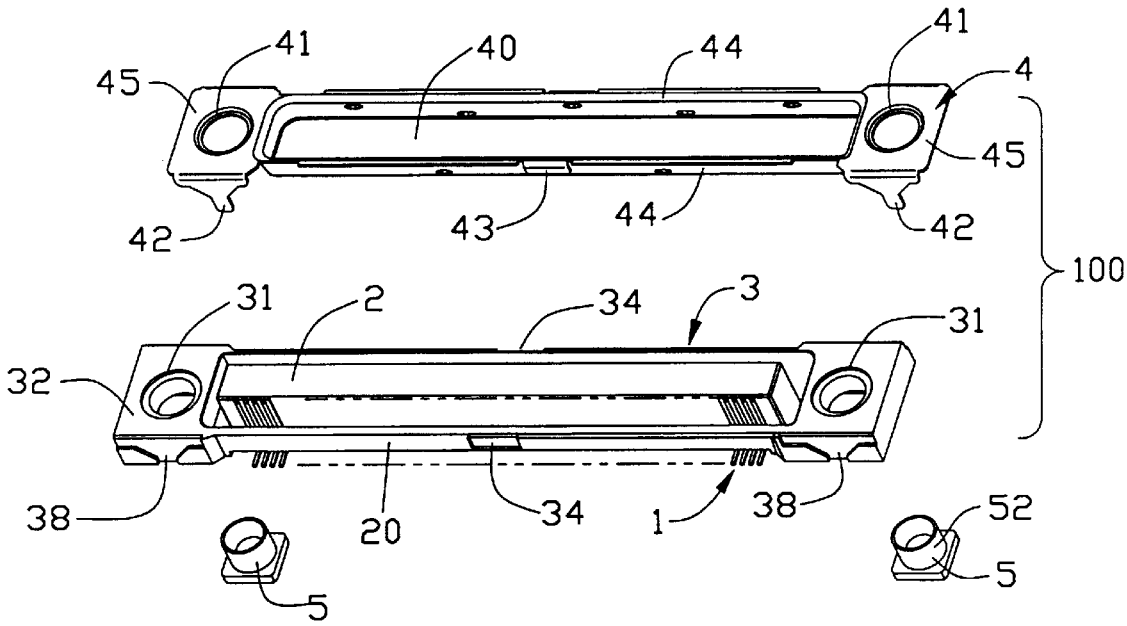
FIG. 9 is an exploded view of the high-density electrical connector assembly.
Figure 10:
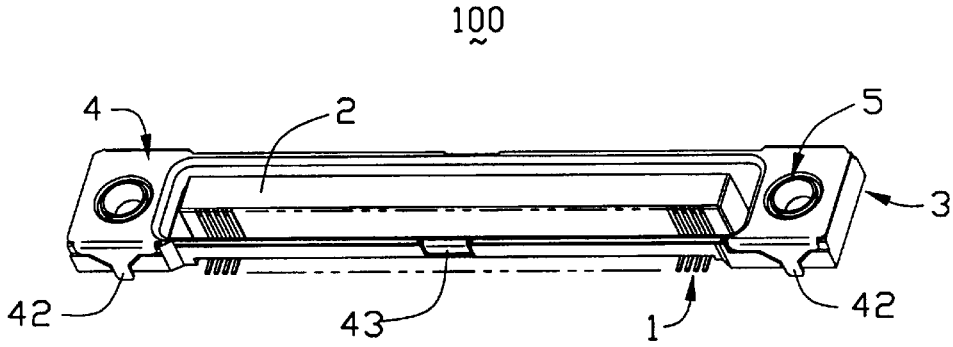
FIG. 10 is an assembled view of FIG. 9.

Referring to FIGS. 9 and 10, a high-density electrical connector 100 of the present invention comprises a dielectric housing 3, two sets of SMT contacts 1, a shield 4 mounting on the housing 3, and a pair of nuts 5 joining the housing 3 and the shield 4 together. The housing 3 comprises an elongate first housing member 2 and a second housing member 20 around the first housing member 2. The two sets of SMT contacts 1 are respectively retained in opposite sides of the first housing member 2. The shield 4 is stamped and formed from a sheet of metal and comprises a pair of parallel beams 44 and a pair of aprons 45 connecting opposite free ends of the beams 44. A slot 40 is defined between the beams 44 and the aprons 45. Each apron 45 defines a cutout 41 in a middle portion thereof, and forms a pair of feet 42 downwardly extending from each apron 45 for being soldered to a circuit board (not shown). A tongue 43 downwardly extends from a middle portion of each beam 44 for securing the shield 4 to the housing 3.

Figure 1:
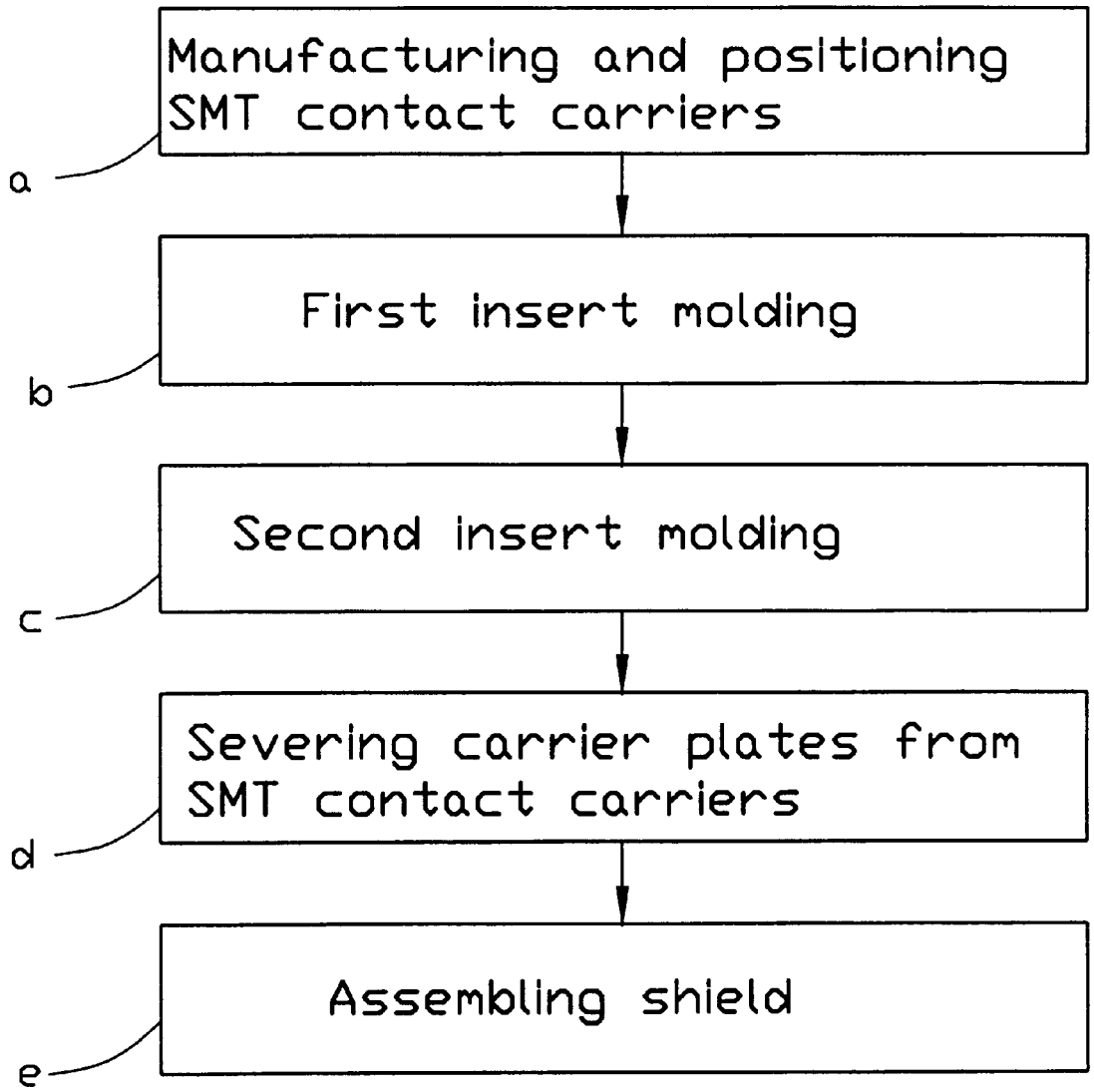
FIG. 1 is a flow chart illustrating the manufacturing process of a high-density electrical connector in accordance with the present invention.
Figure 2:
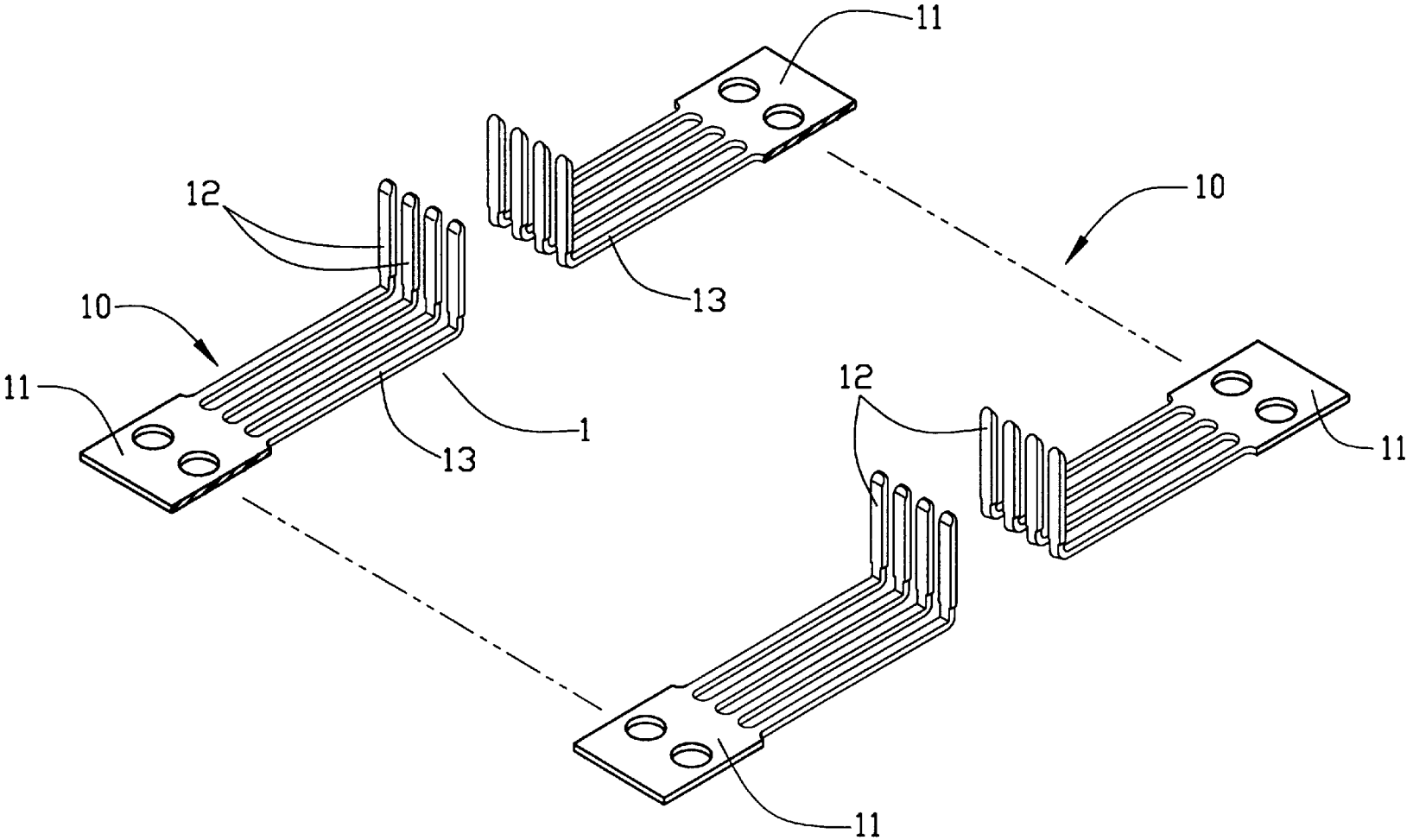
FIG. 2 is a perspective view of a pair of positioned SMT contact carriers of the high-density electrical connector.
Figure 3:
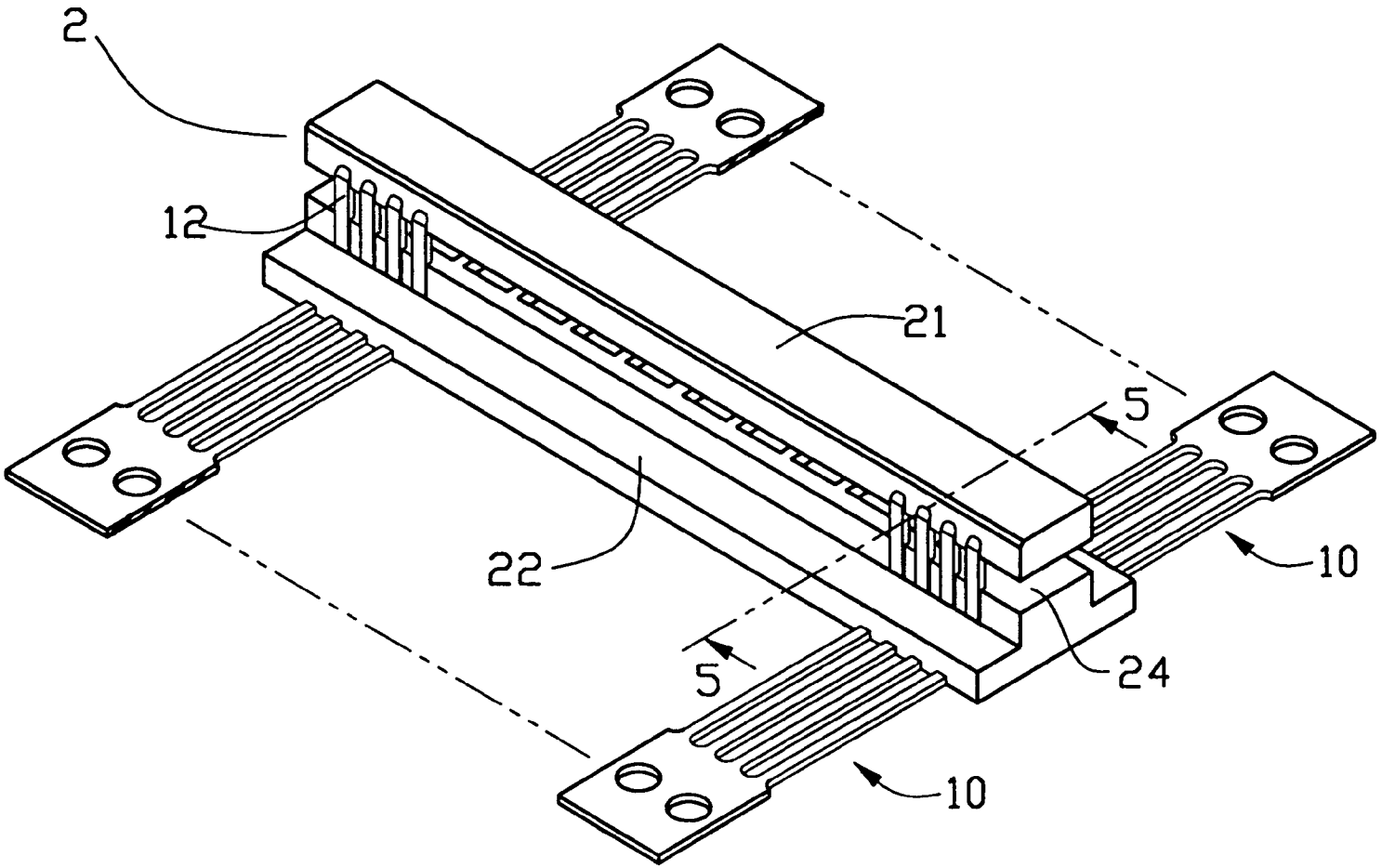
FIG. 3 is a perspective view of sections of a first housing member of the housing insert molded to the pair of SMT contact carriers.
Figure 4A:
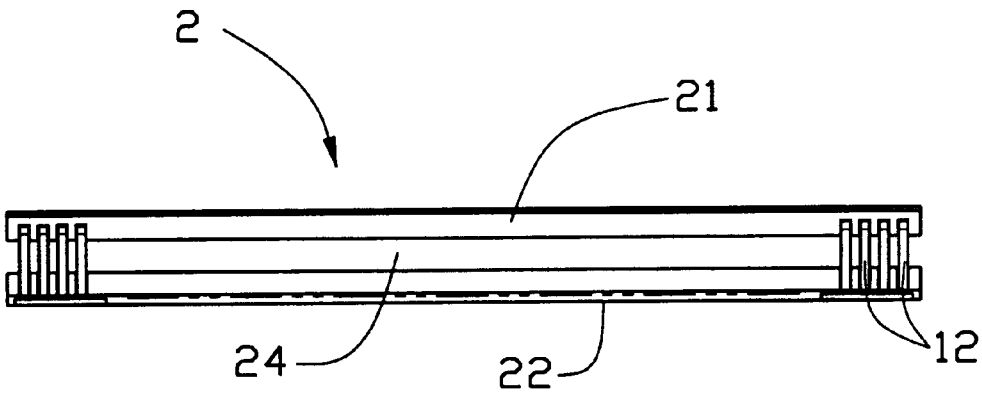
FIG. 4A is a front view of FIG. 3.
Figure 4B:
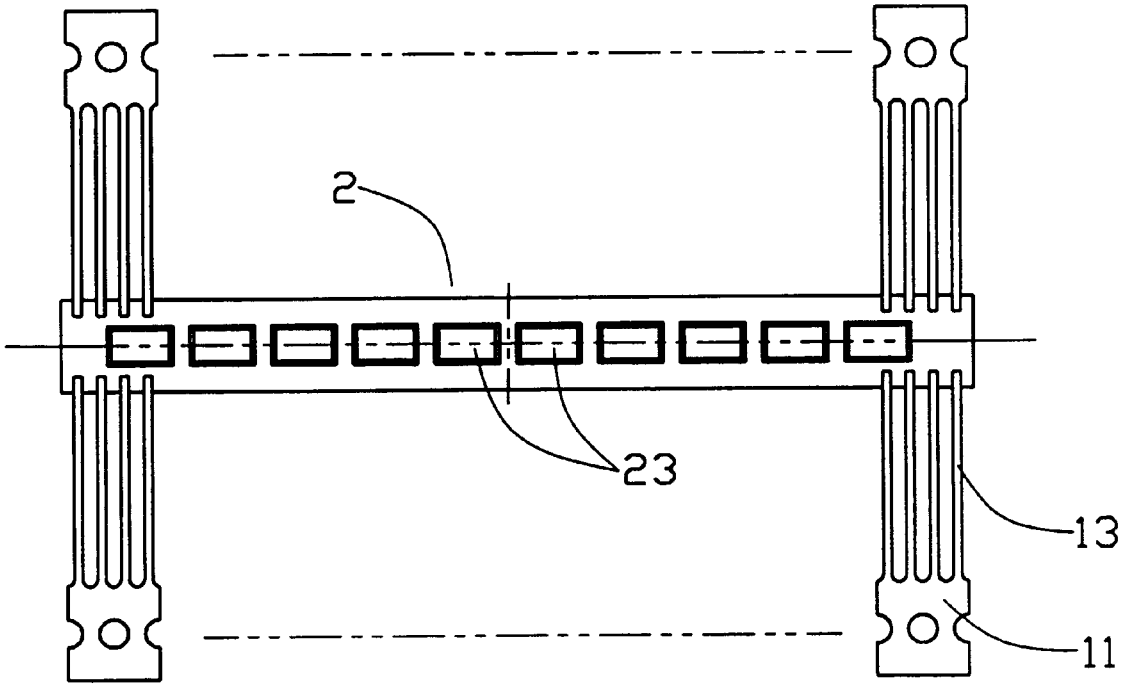
FIG. 4B is a bottom view of FIG. 3.
Figure 5:
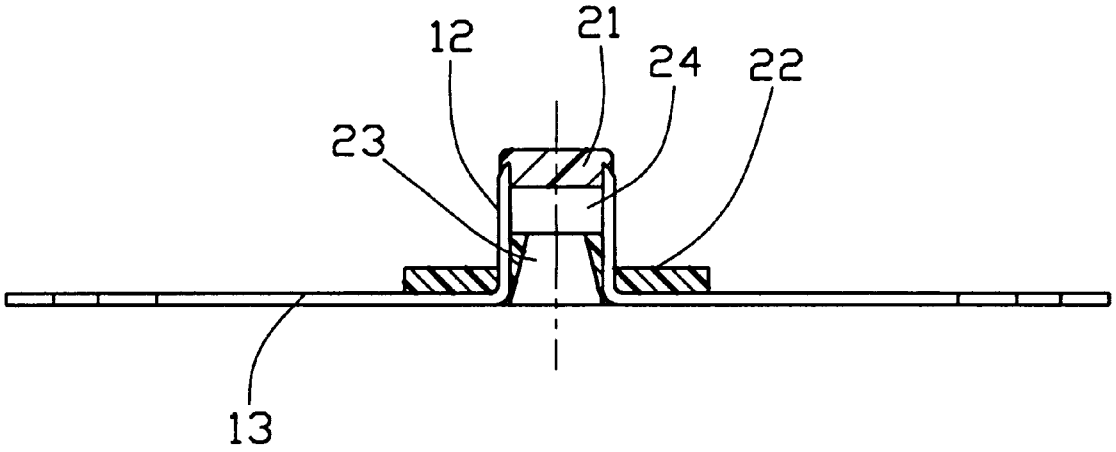
FIG. 5 is a cross-sectional view taken along line 5—5 of FIG. 3.
Figure 6:
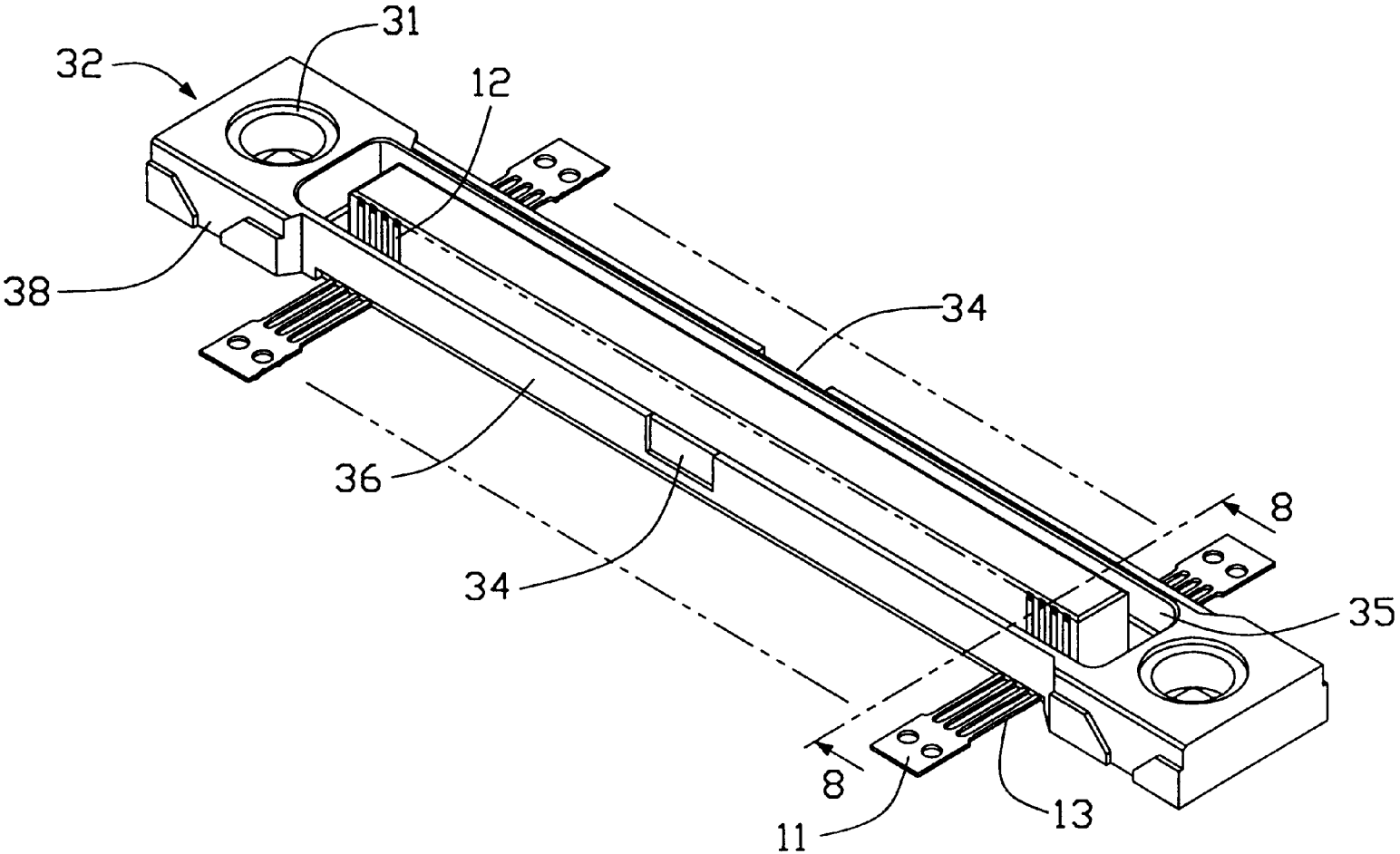
FIG. 6 is a perspective view of the high-density electrical connector after a second insert molding procedure.
Figure 7A:
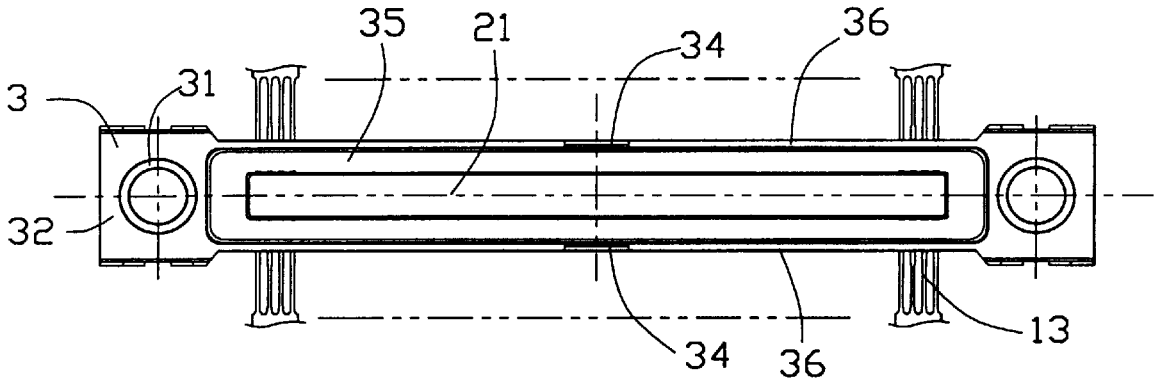
FIG. 7A is a top view of FIG. 6.
Figure 7B:
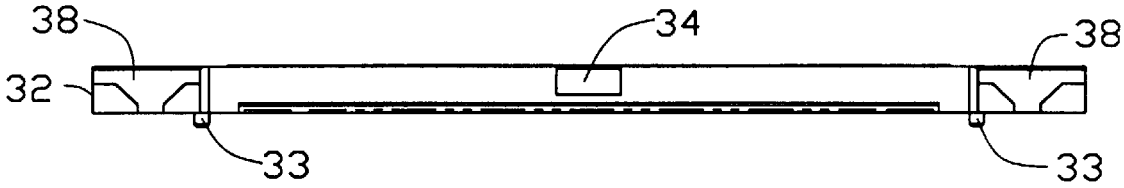
FIG. 7B is a front view of FIG. 6.
Figure 8:
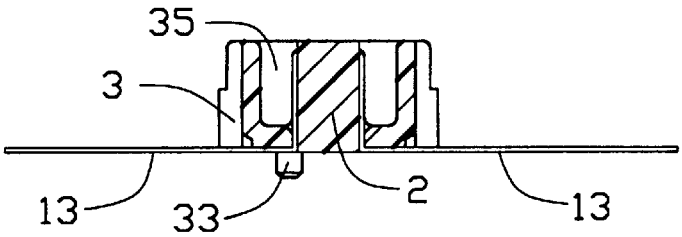
FIG. 8 is a cross-sectional view taken along line 8—8 of FIG. 6.

Referring to FIG. 1, a method of manufacturing the high-density electrical connector 100 of the present invention comprises the steps of:

a. Manufacturing and positioning SMT contact carriers:

Also referring to FIG. 2, a metal sheet is stamped to form an SMT contact carrier 10 comprising a set of SMT contacts 1 and a first carrier plate 11 joining the SMT contacts 1 together. Each SMT contact 1 is perpendicularly bent at a predetermined position to form a mounting portion 13 for mounting to a circuit board (not shown) and a mating portion 12 for mating with a mated connector (not shown). The pair of SMT contact carriers 10 are positioned opposite one another with a gap formed between the mating portions 12 thereof and free ends of the mating portions 12 of the SMT contacts 1 being coplanar.

b. First insert molding:

Referring to FIGS. 3, 4(A), 4(B) and 5, the pair of positioned SMT contact carriers 10 are set in a first mold (not shown) and molten dielectric material is injected into the first mold. When cooled, the molten dielectric material solidifies to form a base 22, a crossbeam 21 and a gap 24 between the base 22 and the crossbeam 21. The crossbeam 21 and the base 22 respectively retain the mating portions 12 and the mounting portions 13 of the SMT contacts 1 in opposite sides thereof to form a combination. The base 22 defines a plurality of openings 23 therethrough communicating with the gap 24. The gap 24 and the openings 23 are configured as channels for molten dielectric material flowing therethrough for facilitating a second insert molding process (described in detail hereinafter).

c. Second insert molding:

Referring to FIGS. 6, 7(A), 7(B) and 8, the combination of the base 22, the crossbeam 21 and the SMT contact carries 10 is positioned in a second old, and the same kind of molten dielectric material as was used in step "b" is then injected into the second mold. The molten dielectric material firstly flows through and fills the openings 23 and the gap 24 to constitute a first housing member 2, and then forms a second housing member 20 surroundingly incorporating the first housing member 2 to form the housing 3. The second housing member 20 comprises a pair of parallel side portions 36, a pair of stations 32 at distal ends of the side portions 36, and a recessed portion 35 defined between the stations 32 and the side portions 36. Each station 32 defines a through hole 31 in a middle portion thereof. The second housing member 20 respectively defines a recess 34 and a pair of notches 38 in a middle portion and at opposite ends of both elongate sides thereof. The second housing member 20 further forms a pair of posts 33 in a bottom face thereof.

d. Severing the carrier plates from the SMT contact carriers:

The carrier plates 11 are severed from the contact mounting portions 13 of the SMT contact carriers 10 at predetermined positions.

e. Assembling the shield to the housing:

Referring to FIGS. 8 and 9, the shield 4 is assembled to the housing 3 with the cutouts 41 thereof being coaxial with the through holes 31 of the housing 3. The feet 42 are received in the corresponding notches 38 and the tongues 43 are received in the corresponding recesses 34. Each nut 5 is inserted into the through hole 31 of the housing 3 and the cutout 41 of the shield 4 with a head 52 thereof extending beyond the apron 45 of the shield 4. The heads 52 are hit by a tool to rivet the shield 4 to the housing 3.

Since the SMT contacts 1 are insert molded into the housing 3, rather than being placed therein using insertion techniques, the forces acting on the contacts 1 are minimized and the shape of the SMT contacts 1 changes minimally. Therefore, proper alignment, engagement and coplanarity of the SMT contacts 1 assembled in the housing 3 are easily obtained. Additionally, the compact alignment of the contacts 1 allows the connector 100 to be soldered to a limited space.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A high-density electrical connector comprising:

a dielectric housing comprising a first molded housing member and a second housing member molded around the first housing member; and two sets of contacts insert molded in and engaging opposite sides of the first and second housing members;

wherein each contact has a mating portion and a mounting portion retained in the first and second housing members;

wherein the housing defines a recess between the first and second housing members;

further comprising a metal shield mounted on a mating face of the second housing member.

* * * * *